US008840412B2

(12) United States Patent
Ohyama et al.

(10) Patent No.: US 8,840,412 B2
(45) Date of Patent: Sep. 23, 2014

(54) WATERPROOF CONNECTOR

(75) Inventors: Kouichi Ohyama, Makinohara (JP); Keishi Jinno, Makinohara (JP)

(73) Assignee: Yazaki Corporation, Tokyo (JP)

( * ) Notice: Subject to any disclaimer, the term of this patent is extended or adjusted under 35 U.S.C. 154(b) by 30 days.

(21) Appl. No.: 13/808,335

(22) PCT Filed: Jul. 26, 2011

(86) PCT No.: PCT/JP2011/066949

§ 371 (c)(1),
(2), (4) Date: Jan. 4, 2013

(87) PCT Pub. No.: WO2012/014884

PCT Pub. Date: Feb. 2, 2012

(65) Prior Publication Data

US 2013/0109212 A1 May 2, 2013

(30) Foreign Application Priority Data

Jul. 26, 2010 (JP) ..... 2010-167081

(51) Int. Cl.
*H01R 13/52* (2006.01)
*H01R 12/77* (2011.01)

(52) U.S. Cl.
CPC ..... *H01R 13/5221* (2013.01); *H01R 12/774* (2013.01)
USPC ..... 439/271

(58) Field of Classification Search
CPC ..... H01R 13/5221; H01R 12/774
USPC ..... 439/272
See application file for complete search history.

(56) References Cited

U.S. PATENT DOCUMENTS 4,794,691 A * 1/1989 Brandeau ..... 29/861
7,241,165 B2 * 7/2007 Scheer et al. ..... 439/492
2010/0240252 A1 9/2010 Cappe et al.

(Continued)

FOREIGN PATENT DOCUMENTS

JP 62121785 U 8/1987
JP 48271 U 1/1992

(Continued)

OTHER PUBLICATIONS

International Search Report dated Sep. 27, 2011 from the International Searching Authority in counterpart application No. PCT/JP2011/066949.

(Continued)

*Primary Examiner* — James Harvey
(74) *Attorney, Agent, or Firm* — Sughrue Mion, PLLC

(57) ABSTRACT

A waterproof connector includes a plate-like cable having a plurality of conductor parts, a connector housing having a rectangular insertion opening, a sealing member through which the plate-like cable is inserted and that seals between the insertion opening and the plate-like cable, and a holder that covers an outer periphery of an opening end part of the connector housing, that has a lock part which engages with the opening end part, and that holds the plate-like cable. A plurality of bosses are protruded on the holder and are inserted into a plurality of connector side through holes formed in the opening end part and a plurality of cable side through holes formed in the plate-like cable. A back end surface of the sealing member abuts against the plurality of bosses.

1 Claim, 6 Drawing Sheets

(56) References Cited

U.S. PATENT DOCUMENTS

| | | | | |
|---|---|---|---|---|
| 2013/0109212 | A1* | 5/2013 | Ohyama et al. | 439/272 |
| 2013/0137285 | A1* | 5/2013 | Miura et al. | 439/271 |
| 2013/0137293 | A1* | 5/2013 | Miura et al. | 439/499 |
| 2013/0280947 | A1* | 10/2013 | Matoba et al. | 439/372 |
| 2014/0045370 | A1* | 2/2014 | Ohyama | 439/519 |

FOREIGN PATENT DOCUMENTS

| | | | |
|---|---|---|---|
| JP | 06-005327 | A | 1/1994 |
| JP | 6203910 | A | 7/1994 |
| JP | 2002-170627 | A | 6/2002 |
| JP | 2002203632 | A | 7/2002 |
| JP | 2008171596 | A | 7/2008 |
| JP | 2008192545 | A | 8/2008 |
| JP | 2009537059 | A | 10/2009 |

OTHER PUBLICATIONS

Written Opinion dated Sep. 27, 2011 from the International Searching Authority in counterpart application No. PCT/JP2011/066949.

* cited by examiner

WATERPROOF CONNECTOR

TECHNICAL FIELD

The present invention relates to a waterproof connector.

BACKGROUND ART

Traditionally, a waterproof connector is known which includes a flexible flat cable as a plate-like cable which has flexibility, such as a flexible circuit board (FPC), an insulating housing as a connector into which the flexible flat cable is inserted, a sealing member which is accommodated in a contact insertion opening of the insulating housing, and which has a slit through which the flexible flat cable can be inserted, and a sealing member pressing member as a holder which is hinge-coupled at near the contact insertion opening and which has a slot through which the flexible flat cable can pass (for example, refer to a patent document 1).

In this waterproof connector, the waterproofness between the flexible flat cable and the insulating housing is secured by making the sealing member, which is accommodated in the contact insertion opening, to be compressed by the sealing member pressing member.

RELATED ART DOCUMENTS

Patent Document

[Patent document 1] JP-A-6-203910

SUMMARY OF THE INVENTION

Problems to be Solved by the Invention

However, in the above waterproof connector, since the plate-like cable passes through the slot of the holder, the holding of the plate-like cable in the width direction is not performed reliably, and there is a possibility that the plate-like cable may be unsteady inside the slot of the holder.

Thus, the object of the invention is to provide a waterproof connector which can perform the holding of a plate-like cable to a connector housing reliably.

Means for Solving the Problems

The above object of the invention is achieved by the following construction.

(1) A waterproof connector includes: a plate-like cable that is provided with a plurality of conductor parts; a connector housing that is provided with a rectangular insertion opening into which the plate-like cable is inserted; a sealing member through which the plate-like cable is inserted and that seals between the insertion opening and the plate-like cable; and a holder that covers an outer periphery of an opening end part of the connector housing where the insertion opening is formed, that is provided with a lock part which engages with the opening end part, and that holds the plate-like cable relative to the insertion opening, wherein a plurality of bosses, which are inserted into a plurality of connector side through holes formed in upper and lower surfaces of the opening end part respectively, are protruded on the holder; wherein a plurality of cable side through holes into which the plurality of bosses are inserted are formed in the plate-like cable at a back end side in an insertion direction in which the sealing member is inserted into the connector housing; and wherein a back end surface of the sealing member abuts against the plurality of bosses which are inserted into the plurality of cable side through holes.

In the waterproof connector of the construction of the above (1), since the plurality of bosses of the holder are inserted into the plurality of connector side through holes formed respectively in the upper and lower surfaces of the opening end part of the connector housing where the insertion opening is formed, and the plurality of bosses are inserted into the plurality of cable side through holes of the plate-like cable, the position of the plate-like cable in the width direction in the insertion opening can be fixed.

Since the back end surface of the sealing member, through which the plate-like cable is inserted, abuts against the plurality of bosses which are inserted into the plurality of cable side through holes, the position of the plate-like cable in the length direction in the insertion opening can be fixed.

Therefore, according to the waterproof connector of the construction of the above (1), the plate-like cable can be prevented from being unsteady in the insertion opening, and the plate-like cable can be reliably held relative to the connector housing.

BRIEF DESCRIPTION OF THE DRAWINGS

FIG. 4(*b*) is an enlarged view when FPC is applied to the plate-like cable of the waterproof connector according to the embodiment of the invention.

MODE FOR CARRYING OUT THE INVENTION

A waterproof connector according to an embodiment of the invention is described using FIGS. 1 to 10.

Figure 1:
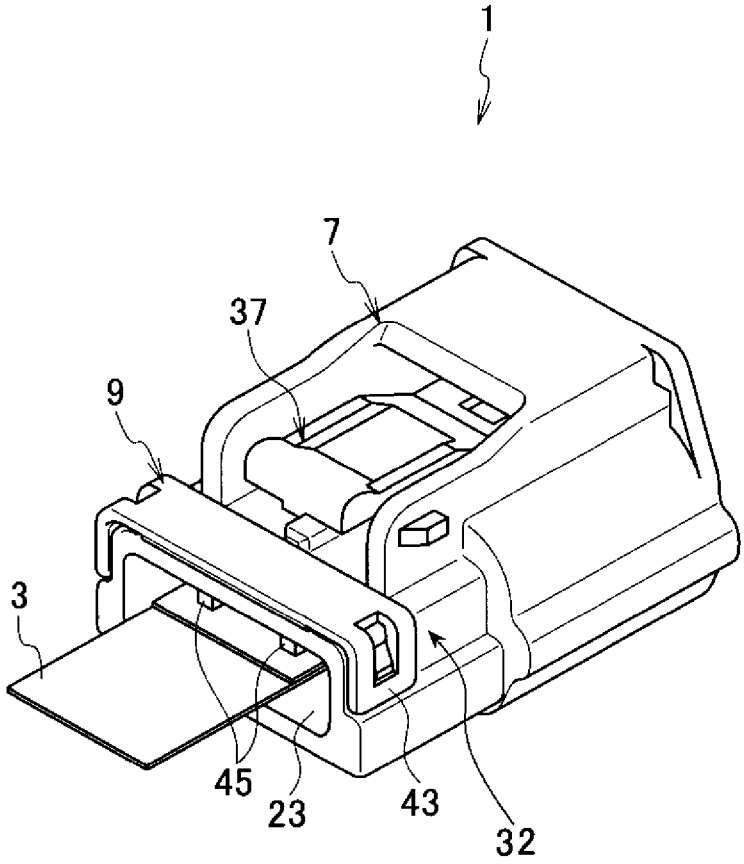
FIG. 1 is a perspective view of a waterproof connector according to an embodiment of the invention.
Figure 2:
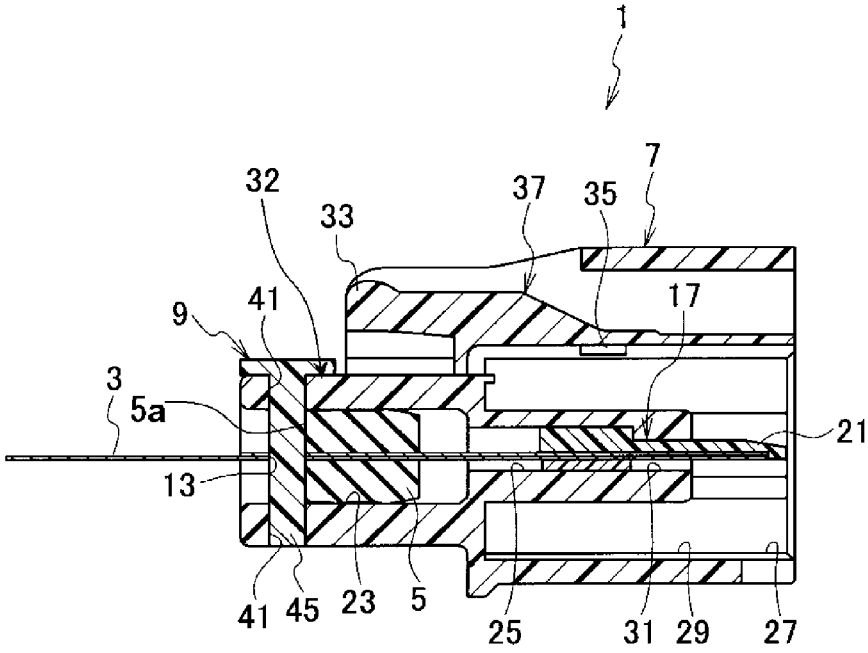
FIG. 2 is a cross sectional view of the waterproof connector according to the embodiment of the invention.

As shown in FIGS. 1 and 2, a waterproof connector 1 according to the embodiment includes a plate-like cable 3, a sealing member 5, a connector housing 7 and a holder 9.

Figure 3:
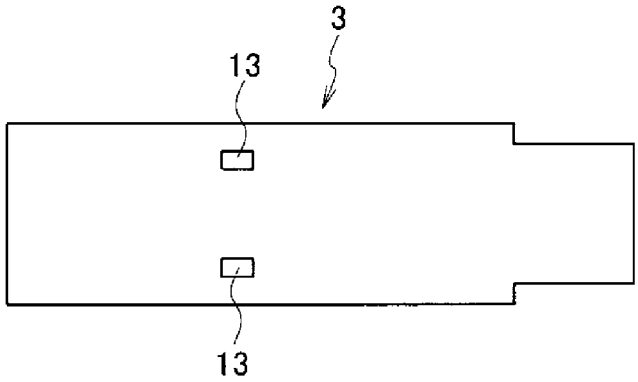
FIG. 3 is a top view of a plate-like cable of the waterproof connector according to the embodiment of the invention.
Figure 4:
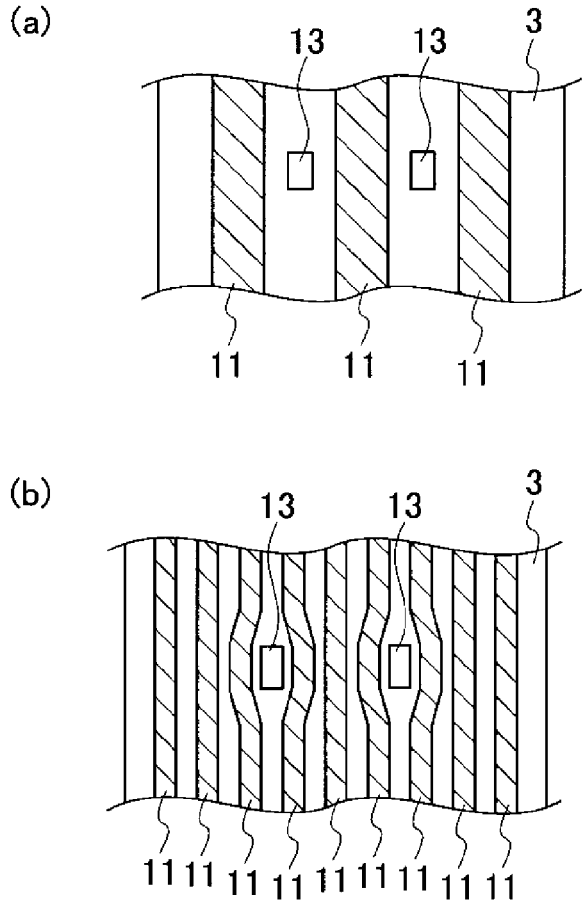
FIG. 4(*a*) is an enlarged view when FPC or FFC is applied to the plate-like cable of the waterproof connector according to the embodiment of the invention.
Figure 5:
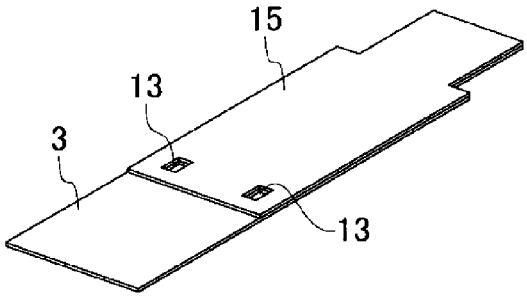
FIG. 5 is a perspective view when a reinforcing plate is provided on the plate-like cable of the waterproof connector according to the embodiment of the invention.

As shown in FIGS. 3 to 5, the plate-like cable 3 is a plate-like cable which has flexibility such as a flexible circuit board (FPC) or a flexible flat cable (FFC), and is provided with a plurality of conductor parts 11. Among the plurality of conductor parts 11, a plurality of (here two) cable side through holes 13 into which bosses 45 of the holder 9 are inserted are provided.

The cable side through holes 13 are located between the conductor parts 11 which are adjacent to each other, and are provided so as to penetrate the plate-like cable 3 in the thickness direction. A reinforcing plate 15, which covers the plurality of conductor parts 11, is integrally provided on the upper surface of the plate-like cable 3, and through holes are also provided in the reinforcing plate 15 at positions where the cable side through holes 13 are located. For example, when FPC or FFC is applied to the plate-like cable 3, as shown in FIG. 4(*a*), in a case of increasing the pitch between the plurality of conductor parts 11, the cable side through holes 13 can be formed in any place without having influence on the conductor parts 11. For example, when FPC is applied to the plate-like cable 3, as shown in FIG. 4(*b*), since the plurality of conductor parts 11 can be wired freely, and the conductor parts 11 can be wired by being kept away from the cable side through holes 13, the cable side through holes 13 can be formed in any place without having influence on the conductor parts 11.

A cable assembly 19 is formed by assembling a slider 17 and the sealing member 5 to the plate-like cable 3.

Figure 6:
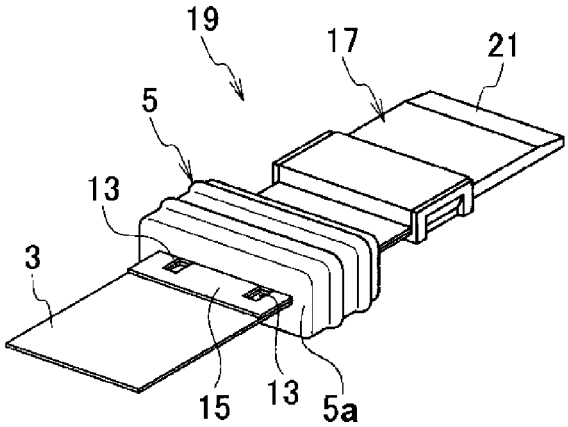
FIG. 6 is a perspective view of a cable assembly of the waterproof connector according to the embodiment of the invention.

As shown in FIG. 6, the slider 17 is made of resin material and includes two divided members that cover an upper surface and a bottom surface of the plate-like cable 3. In the slider 17, a bottom surface side member of the slider 17 covers the plate-like cable 3 so that a part of the front end side of the conductor parts 11 is exposed outside, and an upper surface side member of the slider 17 covers the whole front end side of the conductor parts 11 of the plate-like cable 3. The front end side of the slider 17 has a connecting part 21 which is electrically connected with a fork-like mating terminal (not shown) by being sandwiched into the mating terminal. As shown in FIG. 2, the connecting part 21 is projected from an accommodating part 25 of the connector housing 7 when being accommodated in the accommodating part 25, and is electrically connected with the mating terminal. While the connecting part 21 can be protected by the slider 17, the contact load with the mating terminal can be adjusted by changing the thickness of the connecting part 21 of the slider 17.

Figure 10:
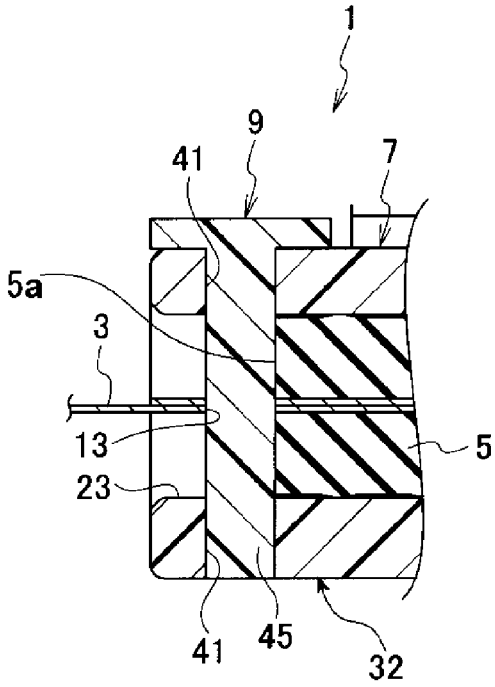
FIG. 10 is an enlarged sectional view of main parts of the waterproof connector according to the embodiment of the invention.

As shown in FIG. 6, the sealing member 5 is made of elastic materials such as rubber, and is integrally molded with the plate-like cable 3 so that the plate-like cable 3 is tightly inserted through a central part of the sealing member 5. As shown in FIG. 2, the outer periphery of the sealing member 5 is elastically adhered with the inner peripheral surface of an insertion opening 23 of the connector housing 7, and seals between the connector housing 7 and the plate-like cables 3. The sealing member 5 is arranged so as to be adjacent to the cable side through holes 13 of the plate-like cable 3 at the front end side in the insertion direction in which the plate-like cable 3 is inserted into the connector housing 7. For this reason, as shown in FIG. 10, when the bosses 45 of the holder 9 are inserted into the cable side through holes 13, the back end surface 5*a* of the sealing member 5 abuts against the bosses 45, and the plate-like cable 3 can be prevented from falling out from the connector housing 7.

The cable assembly 19 in which the slider 17 and the sealing member 5 are assembled to the plate-like cable 3 is assembled to the connector housing 7 by being inserted from the insertion opening 23 of the connector housing 7.

Figure 7:
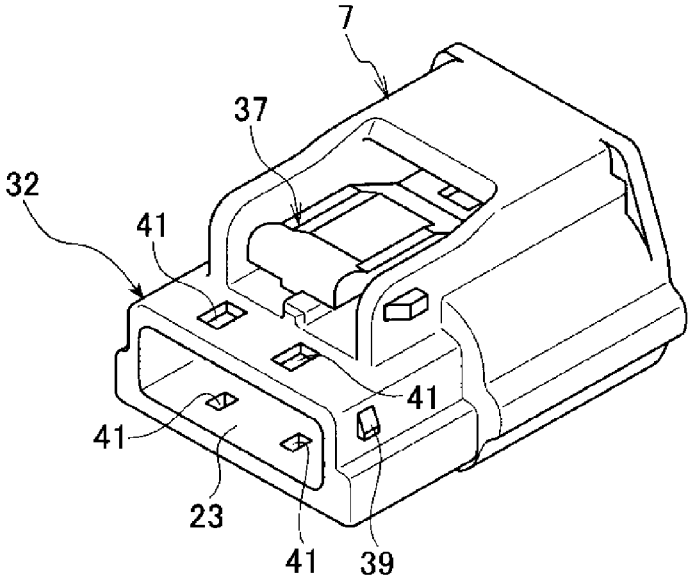
FIG. 7 is a perspective view of a connector housing of the waterproof connector according to the embodiment of the invention.

As shown in FIGS. 2 and 7, the connector housing 7 is made of resin material, and includes the insertion opening 23, the accommodating part 25, a frontage 27 and a mating connector accommodating part 29. The insertion opening 23 is formed into a rectangular shape at an opening end part 32 which opens towards one side of the connector housing 7. The cable assembly 19 is inserted from the insertion opening 23, and the cable assembly 19 is assembled to the connector housing 7. As shown in FIG. 2, the sealing member 5 of the cable assembly 19 is accommodated in the insertion opening 23, and seals between the connector housing 7 and the plate-like cables 3.

The accommodating part 25 is provided inside the connector housing 7 and at the front end side of the insertion opening 23, communicates with the insertion opening 23, and is formed into a pipe-like shape. A through hole 31 is formed in the bottom part of the accommodating part 25. As shown in FIG. 2, the slider 17 of the cable assembly 19 is accommodated in the accommodating part 25, and the connecting part 21 of the slider 17 is inserted into the through hole 31 and is projected in the mating connector accommodating part 29. Thus, by accommodating the slider 17 in the accommodating part 25, the base end side of the connecting part 21 of the slider 17 abuts against the bottom part of the accommodating part 25, and the movement of the cable assembly 19 in the insertion direction to the connector housing 7 can be regulated.

The frontage 27 is opened towards the other side of the connector housing 7. The mating connector (not shown) which accommodates the mating terminal is inserted from this frontage 27, and the mating connector is assembled to the connector housing 7. The frontage 27 communicates with the mating connector accommodating part 29 which accommodates the mating connector.

The mating connector accommodating part 29 is provided inside the connector housing 7 and at the periphery side of the accommodating part 25. The mating connector inserted from the frontage 27 is accommodated in the mating connector accommodating part 29 so that the periphery of the accommodating part 25 is covered. A locking arm 37 has an operating part 33 and a lock part 35, and is provided rockably. The lock part 35 of the locking arm 37 is placed in the mating connector accommodating part 29, and the mating connector is fixed to the connector housing 7.

The connector housing 7 constructed in this way is applied in order to be mounted on a board (not shown) such as a circuit board, and make the plate-like cable 3, which is connected to electronic components or the like, and the mating terminal, which is connected to the board, to be electrically connected. Beak parts 39, to which lock parts 43 of the holder 9 are engaged, are protruded on both the side surfaces of the outer periphery of the opening end part 32 where the insertion opening 23 of the connector housing 7 is formed, and a plurality of (here two) connector side through holes 41, through which the bosses 45 of the holder 9 are inserted, are formed in the upper and lower surfaces, respectively. The connector side through holes 41 are provided at the insertion opening 23 so that when the plate-like cable 3 is assembled to the connector housing 7, the positions of the connector side through holes 41 correspond to those of the cable side through holes 13 of the plate-like cable 3.

Figure 8:
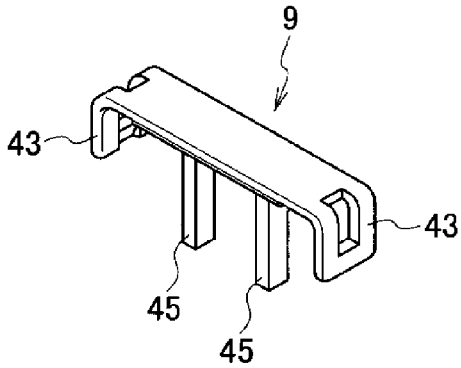
FIG. 8 is a perspective view of a holder of the waterproof connector according to the embodiment of the invention.

As shown in FIG. 8, the holder 9 is made of resin material, and is formed into a U shape so that the upper surface side of the outer periphery of the opening end part 32 of the connector housing 7 is covered. The lock parts 43, which are engaged with the beak parts 39 of the connector housing 7, are provided at the side ends of the U shape of the holder 9, respectively, and the holder 9 is fixed to the connector housing 7. From the central part of the holder 9, the plurality of (here two) bosses 45 are protruded towards the side of the insertion opening 23 of the connector housing 7 (downwards).

Figure 9:
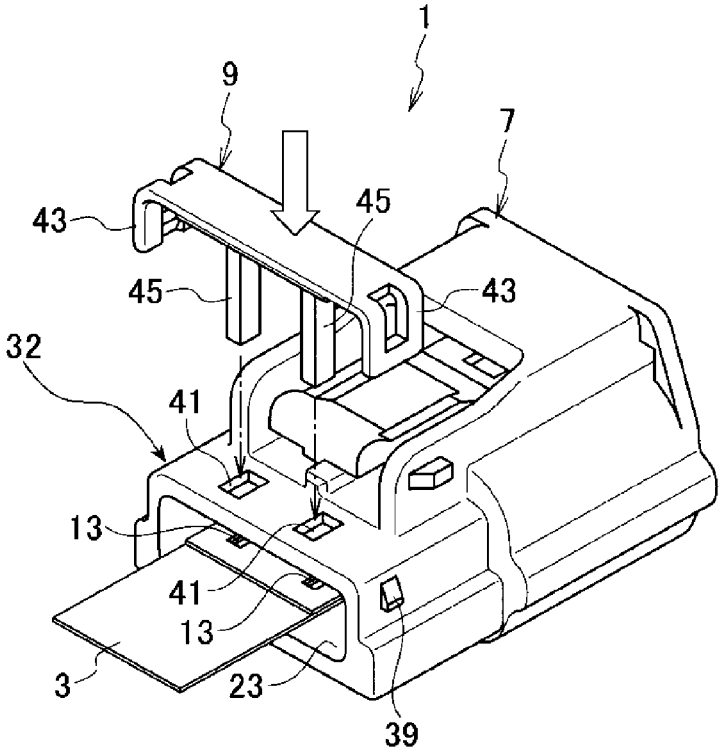
FIG. 9 is a perspective view when the holder of the waterproof connector according to the embodiment of the invention is assembled to the connector housing.

As shown in FIG. 9, the holder 9 is assembled so that the bosses 45 are inserted into the connector side through holes 41 from above the opening end part 32 of the connector housing 7. Thus, in a state of assembling the holder 9 to the connector housing 7 as shown in FIG. 10, by making the bosses 45 of the holder 9 to be inserted into the connector side through holes 41 which are placed at the upper side of the insertion opening 23, the bosses 45 can be inserted into the cable side through holes 13 of the plate-like cable 3, and the connector side through holes 41 which are placed at the lower side of the insertion opening 23. In this state, the beak parts 39 are engaged with the lock parts 43 and the holder 9 is fixed to the connector housing 7. Thus, when the bosses 45 are inserted into the connector side through holes 41 and the cable side through holes 13, the movement of the plate-like cable 3 in the width direction can be regulated. After the bosses 45 of the holder 9 are inserted into the cable side through holes 13 of the plate-like cable 3, as shown in FIG. 10, the bosses 45 abut against the back end surface 5*a* of the sealing member 5. For this reason, the movement of the plate-like cable 3 in the removal direction is regulated, and the plate-like cable 3 can be prevented from falling out from the connector housing 7.

In such a waterproof connector 1, since the plurality of bosses 45 of the holder 9 are inserted into the plurality of connector side through holes 41 provided respectively at the upper and lower surfaces of the opening end part 32 of the connector housing 7 where the insertion opening 23 is formed, and the plurality of bosses 45 are inserted into the plurality of cable side through holes 13 of the plate-like cable 3, the position of the plate-like cable 3 in the width direction in the insertion opening 23 can be fixed.

Since the back end surface 5*a* of the sealing member 5 through which the plate-like cable 3 is inserted abuts against the plurality of bosses 45 which are inserted into the plurality of cable side through holes 13, the position of the plate-like cable 3 in the length direction in the insertion opening 23 can be fixed.

Therefore, the plate-like cable 3 can be prevented from being unsteady in the insertion opening 23, and the plate-like cable 3 can be reliably held relative to the connector housing 7.

In the waterproof connector according to the embodiment of the invention, although the bosses of the holder are inserted through from the upper surface side of the opening end part where the insertion opening of the connector housing is formed towards the lower surface side, it is also possible that the bosses of the holder are inserted through from the lower surface side towards the upper surface side.

Although the mating terminal is accommodated in the mating connector in the above construction, it is also possible to accommodate the mating terminal in the connector housing by providing an accommodating part which accommodates the mating terminal at the frontage side of the connector housing.

The waterproof connector of the present invention is described above in detail with reference to the specific embodiments, but the invention is not limited to the previously described embodiments, and besides, it is apparent that various modifications can be made without changing the purpose of the invention.

This application is based on the Japanese patent application (patent application Number 2010-167081) filed on Jul. 26, 2010, the contents of which are incorporated herein by reference.

INDUSTRIAL APPLICABILITY

According to the waterproof connector of the invention, an effect is achieved that the waterproof connector can be provided in which the holding of the plate-like cable to the connector housing can be performed reliably.

DESCRIPTION OF REFERENCE NUMERALS AND SIGNS

1 waterproof connector
3 plate-like cable
5 sealing member
5*a* back end surface
7 connector housing
9 holder
11 conductor part
13 cable side through hole
23 insertion opening
32 opening end part
41 connector side through hole
43 lock part
45 boss

The invention claimed is:

1. A waterproof connector comprising:

a plate-like cable that is provided with a plurality of conductor parts;

a connector housing that is provided with a rectangular insertion opening into which the plate-like cable is inserted;

a sealing member through which the plate-like cable is inserted and that seals between the insertion opening and the plate-like cable; and a holder that covers an outer periphery of an opening end part of the connector housing where the insertion opening is formed, that is provided with a lock part which engages with the opening end part, and that holds the plate-like cable relative to the insertion opening, wherein a plurality of bosses, which are inserted into a plurality of connector side through holes formed in upper and lower surfaces of the opening end part respectively, are protruded on the holder;

wherein a plurality of cable side through holes into which the plurality of bosses are inserted are formed in the plate-like cable at a back end side in an insertion direction in which the sealing member is inserted into the connector housing; and wherein a back end surface of the sealing member abuts against the plurality of bosses which are inserted into the plurality of cable side through holes.

* * * * *